US005397286A

United States Patent [19]

Chang

[11] Patent Number: 5,397,286

[45] Date of Patent: Mar. 14, 1995

[54] EXERCISE BICYCLE

[75] Inventor: Chi-Ming Chang, Taichung Hsien, Taiwan, Prov. of China

[73] Assignee: Giant Manufacturing Co., Ltd., Taichung Hsien, Taiwan, Prov. of China

[21] Appl. No.: 283,062

[22] Filed: Jul. 28, 1994

Related U.S. Application Data

[63] Continuation of Ser. No. 166,728, Dec. 14, 1993, abandoned.

[51] Int. Cl.[6] ..... A63B 21/00

[52] U.S. Cl. ..... 482/62; 482/59

[58] Field of Search ..... 482/57, 59, 62, 63

[56] References Cited

U.S. PATENT DOCUMENTS

| | | | |
|---|---|---|---|
| 2,419,998 | 5/1947 | Johnson . | |
| 4,436,097 | 3/1984 | Cunningham . | |
| 4,657,244 | 4/1987 | Ross . | |
| 4,705,269 | 11/1987 | DeBoer et al. . | |
| 4,712,789 | 12/1987 | Brilando | 482/62 |
| 4,712,790 | 12/1987 | Szymski | 482/62 |
| 4,838,544 | 6/1989 | Sasakawa et al. | 482/62 |
| 4,895,362 | 1/1990 | Ross . | |
| 4,902,001 | 2/1990 | Balbo . | |
| 5,035,417 | 7/1991 | Ross . | |

FOREIGN PATENT DOCUMENTS 517774 of 0000 Germany .

*Primary Examiner*—Stephen R. Crow

*Attorney, Agent, or Firm*—Harness, Dickey & Pierce

[57] ABSTRACT

The transmission system of an exercise bicycle includes a first drive shaft mounted rotatably on the rear end portion of a frame and provided with foot pedal cranks on two ends thereof, second and third drive shafts mounted rotatably on the frame, a one-way clutch secured on the second drive shaft, a first sprocket mounted securely on the first drive shaft, second and third sprockets mounted securely on the second drive shaft, a fourth sprocket mounted securely on the third drive shaft, a fifth sprocket mounted securely on an axle of a resistance wheel that is mounted rotatably on a front end portion of the frame, a first drive chain trained between the first sprocket and the one-way clutch, a second drive chain trained between the second and fifth sprockets, and a third drive chain trained between the third and fourth sprockets. The exercise bicycle has a reciprocating arm assembly which includes a pair of reciprocating arm levers mounted pivotally on the front end portion of the frame and a pair of crank arms, each of which having a first end connected pivotally to a lower end of a respective one of the arm levers and a second end connected eccentrically to a respective end of the third drive shaft.

1 Claim, 6 Drawing Sheets

EXERCISE BICYCLE

This is a continuation of U.S. patent application Ser. No. 08/166,728, filed Dec. 14, 1993, which has been expressly abandoned.

BACKGROUND OF THE INVENTION

Field of the Invention

The invention relates to an exercise bicycle, more particularly to an exercise bicycle with an improved transmission system.

Description of the Related Art

Referring to FIG. 1, a conventional bicycle exerciser 10 is shown to comprise a frame 11, a foot pedal assembly 12, a reciprocating arm assembly 13, a resistance wheel 14, and a transmission system 15.

The transmission system 15 includes a first drive shaft 121 mounted rotatably on a rear end portion of the frame 11, and a pair of eccentric arms 122 mounted securely on two ends of the first drive shaft 121 and oriented in opposite directions (only one eccentric arm 122 is shown). The foot pedal assembly 12 includes a pair of foot pedal cranks 123 mounted on a distal end of a respective one of the eccentric arms 122 (see FIG. 2). The reciprocating arm assembly 13 includes a pair of reciprocating arm levers 131 mounted pivotally on a front end portion of the frame 11 on two sides of the latter, and a pair of crank arms 132 (see FIG. 2). Each of the crank arms 132 has a first end connected pivotally to a lower end of a respective one of the arm levers 131 and a second end connected to the distal end of a respective one of the eccentric arms 122. Thus, operation of the foot pedal cranks 123 results in forward and rearward movement of the crank arms 132 to produce reciprocating movement of the arm levers 131.

The resistance wheel 14 is mounted rotatably on the front end portion of the frame 11 between the arm levers 131. The transmission system 15 is used to link the foot pedal cranks 123 to the resistance wheel 14 and further includes a second drive shaft 151, four sprockets 152–155, and two drive chains 156, 157. Referring to FIG. 2, the second drive shaft 151 is mounted rotatably on the frame 11 between the front and rear end portions of the latter. The first sprocket 152 is mounted securely on the first drive shaft 121 between the eccentric arms 122. The second and third sprockets 153, 154 are mounted securely on the second drive shaft 151. The fourth sprocket 155 is mounted securely on an axle 141 of the resistance wheel 14. The first drive chain 156 is trained between the first and second sprockets 152, 153. The second drive chain 157 is trained between the third and fourth sprockets 154, 155.

When the foot pedal cranks 123 are operated, the first drive shaft 121 is rotated to cause reciprocating movement of the arm levers 131 and to rotate the first sprocket 152 therewith. The first sprocket 152 drives the second drive shaft 151 to rotate via the second sprocket 153 and the first drive chain 156, thereby rotating the third sprocket 154. The third sprocket 154 drives the axle 141 to rotate via the fourth sprocket 154 and the second drive chain 157, thereby rotating the resistance wheel 14. When the arm levers 131 are oscillated, the crank arms 132 cause the first drive shaft 121 to rotate, thereby resulting in the rotation of the resistance wheel 14.

It has thus been shown that the conventional bicycle exerciser can be used to exercise the upper and lower parts of the body. The conventional bicycle exerciser shown in FIGS. 1 and 2, however, has the following drawbacks:

1. Note that rotation of the foot pedal cranks 123 occurs when the arm levers 131 are oscillated. Thus, banging of the foot pedal cranks 123 against the legs of the user usually occurs.

2. Smooth operation of the foot pedal assembly 12 is difficult to achieve because the foot pedal cranks 123 are connected eccentrically to the first drive shaft 121.

SUMMARY OF THE INVENTION

The main objective of the present invention is to provide an exercise bicycle with a novel transmission system which can overcome the drawbacks commonly associated with the prior art.

More specifically, the objective of the present invention is to provide an exercise bicycle in which the foot pedal cranks are not connected eccentrically to a drive shaft and in which rotation of the foot pedal cranks can be prevented when the reciprocating arm levers are oscillated.

Accordingly, the exercise bicycle of the present invention includes a frame with a front end portion and a rear end portion, a seat mounted on the frame, a foot pedal assembly including a pair of foot pedal cranks, a resistance wheel having an axle mounted rotatably on the front end portion of the frame, a transmission system to link the foot pedal assembly to the resistance wheel, and a reciprocating arm assembly including a pair of reciprocating arm levers mounted pivotally on the front end portion of the frame.

The transmission system includes: a first drive shaft mounted rotatably on the rear end portion of the frame, the foot pedal cranks being mounted on two ends of the first drive shaft; a second drive shaft mounted rotatably on the frame between the front and rear end portions; a one-way clutch including an inner wheel with an inner periphery and an outer periphery, the inner wheel being secured on the second drive shaft, an outer wheel with an inner periphery and an outer periphery formed with sprocket teeth, and a ratchet-and-pawl unit formed on the outer periphery of the inner wheel and the inner periphery of the outer wheel; a third drive shaft mounted rotatably on the frame between the front and rear end portions of the frame; a first sprocket mounted securely on the first drive shaft; second and third sprockets mounted securely on the second drive shaft; a fourth sprocket mounted securely on the third drive shaft; a fifth sprocket mounted securely on the axle of the resistance wheel; a first drive chain trained between the first sprocket and the outer wheel of the one-way clutch; a second drive chain trained between the second and fifth sprockets; and a third drive chain trained between the third and fourth sprockets.

The reciprocating arm assembly further includes a pair of crank arms, each of which having a first end connected pivotally to a lower end of a respective one of the arm levers and a second end connected eccentrically to a respective end of the third drive shaft.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
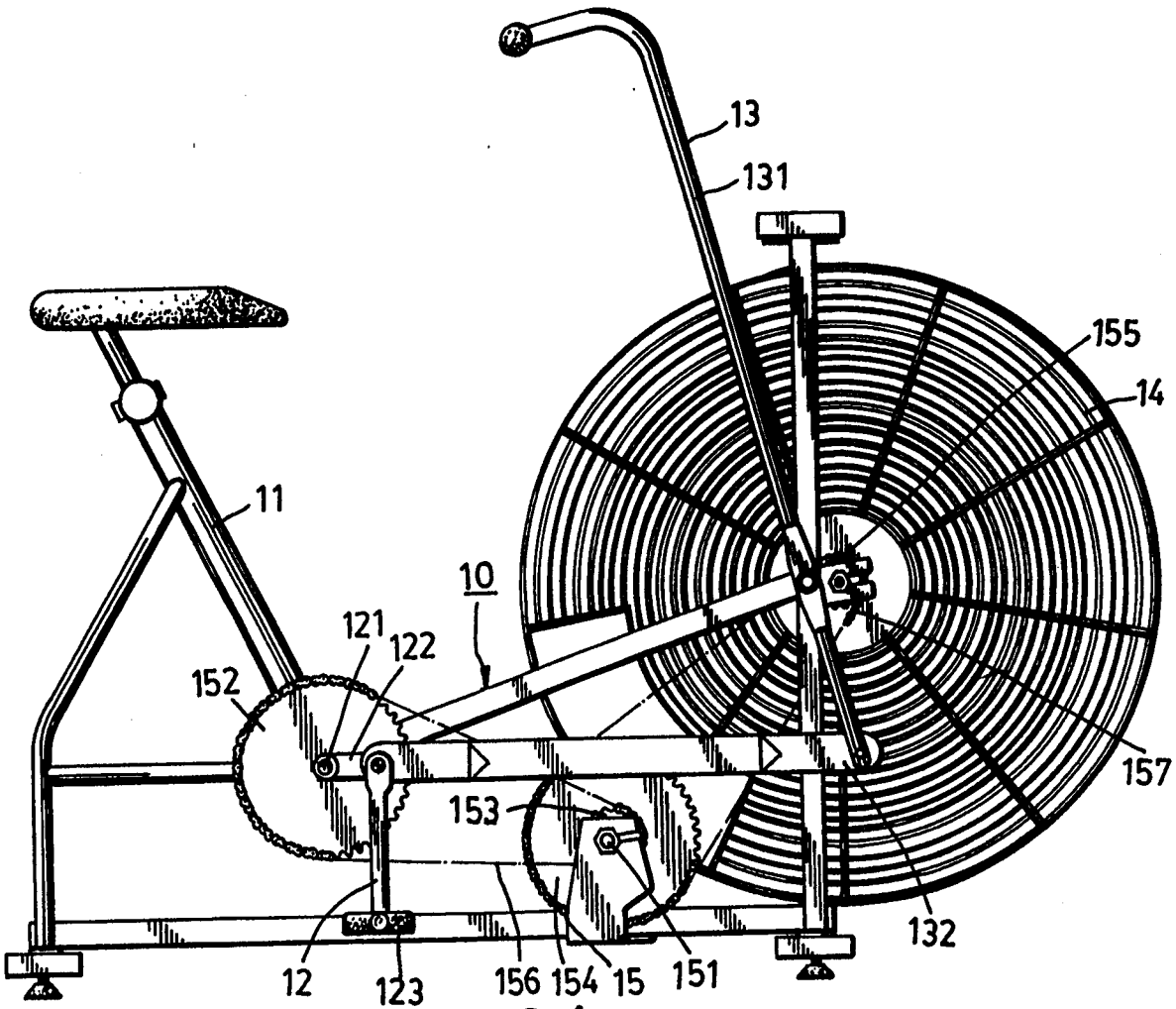
FIG. 1 PRIOR ART
FIG. 1 is a side view of a conventional exercise bicycle.
Figure 2:
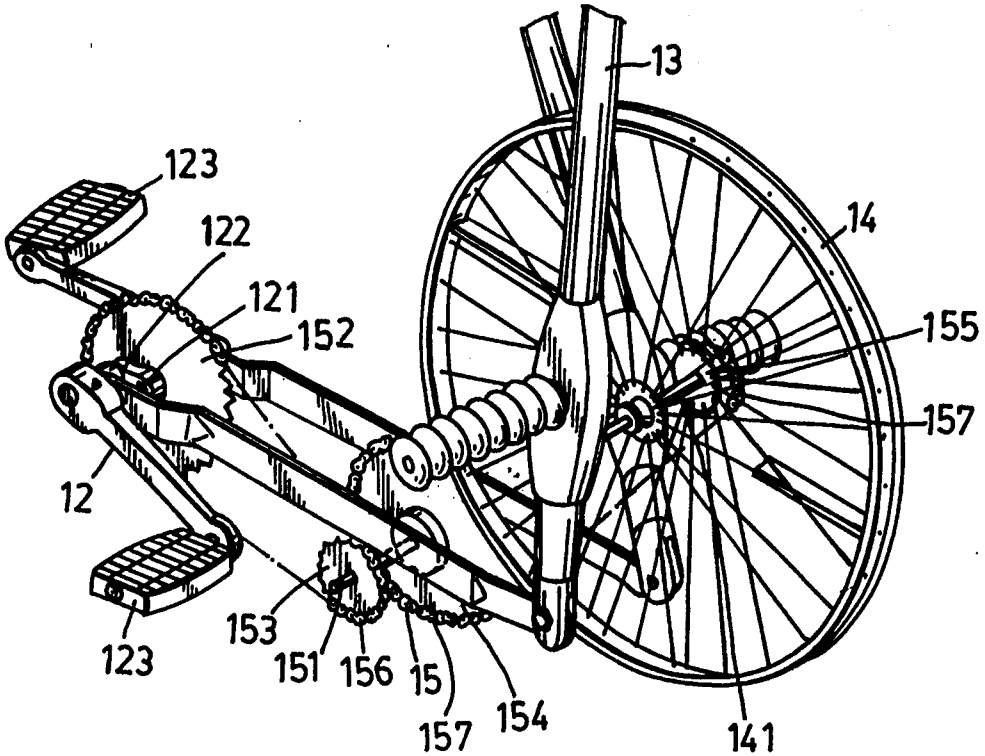
FIG. 2 PRIOR ART
FIG. 2 is a perspective view illustrating the transmission system of the conventional exercise bicycle shown in FIG. 1.
Figure 3:
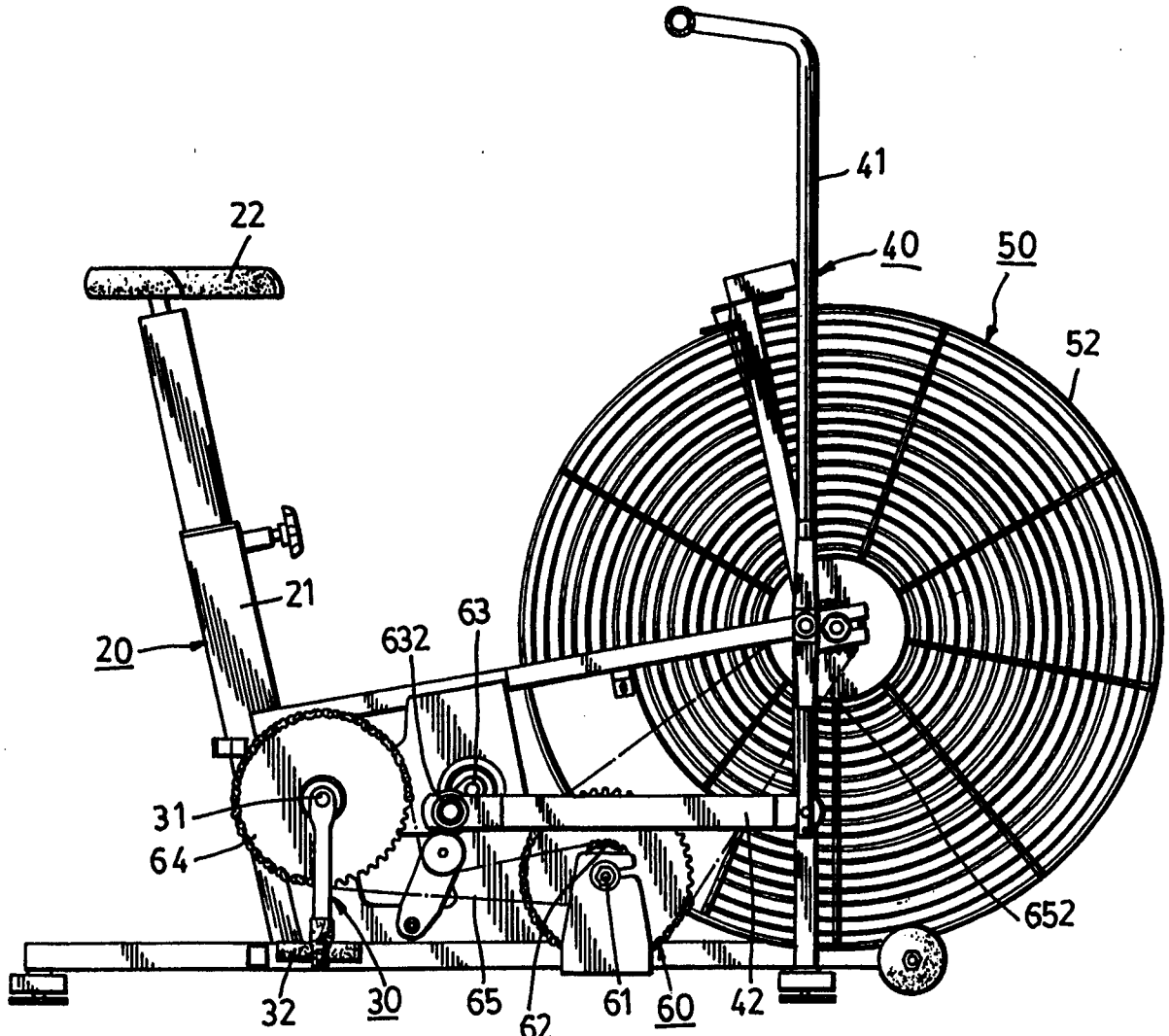
FIG. 3 is a side view of the preferred embodiment of an exercise bicycle according to the present invention.

Referring to FIG. 3, the preferred embodiment of an exercise bicycle according to the present invention is shown to comprise a frame 20, a foot pedal assembly 30, a reciprocating arm assembly 40, a resistance wheel 50, and a transmission system 60.

The frame 20 has a rear end portion which is provided with a seat support 21 for mounting a seat 22 thereon. The transmission system 60 includes a first drive shaft 31 mounted rotatably on the rear end portion of the frame 20. The foot pedal assembly 30 includes a pair of foot pedal cranks 32 mounted on two ends of the first drive shaft 31 (see FIG. 4). The reciprocating arm assembly 40 includes a pair of reciprocating arm levers 41 mounted pivotally on a front end portion of the frame 20 on two sides of the latter, and a pair of crank arms 42 (see FIG. 4). The resistance wheel 50 has an axle 511 (see FIG. 4) which is mounted rotatably on the front end portion of the frame 20 between the arm levers 41. The frame 20 is further provided with a fender 52 which covers a portion of the resistance wheel 50.

Figure 4:
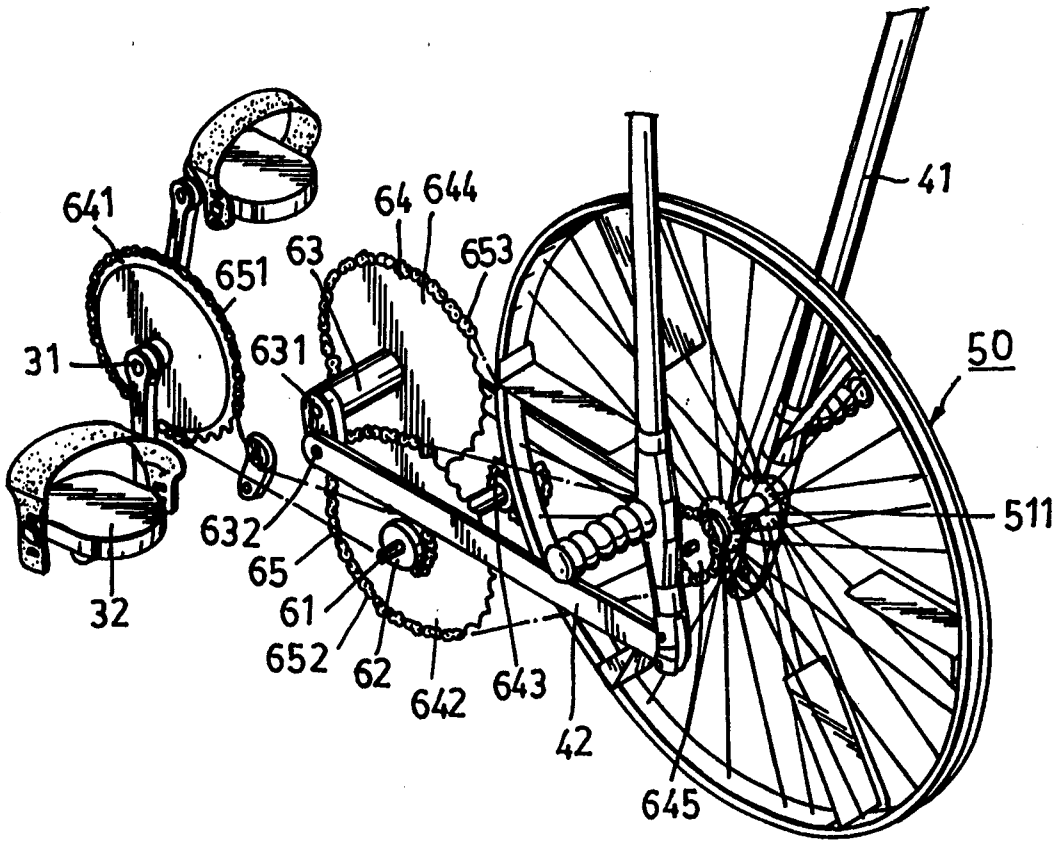
FIG. 4 is a perspective view illustrating the transmission system of the preferred embodiment.
Figure 5:
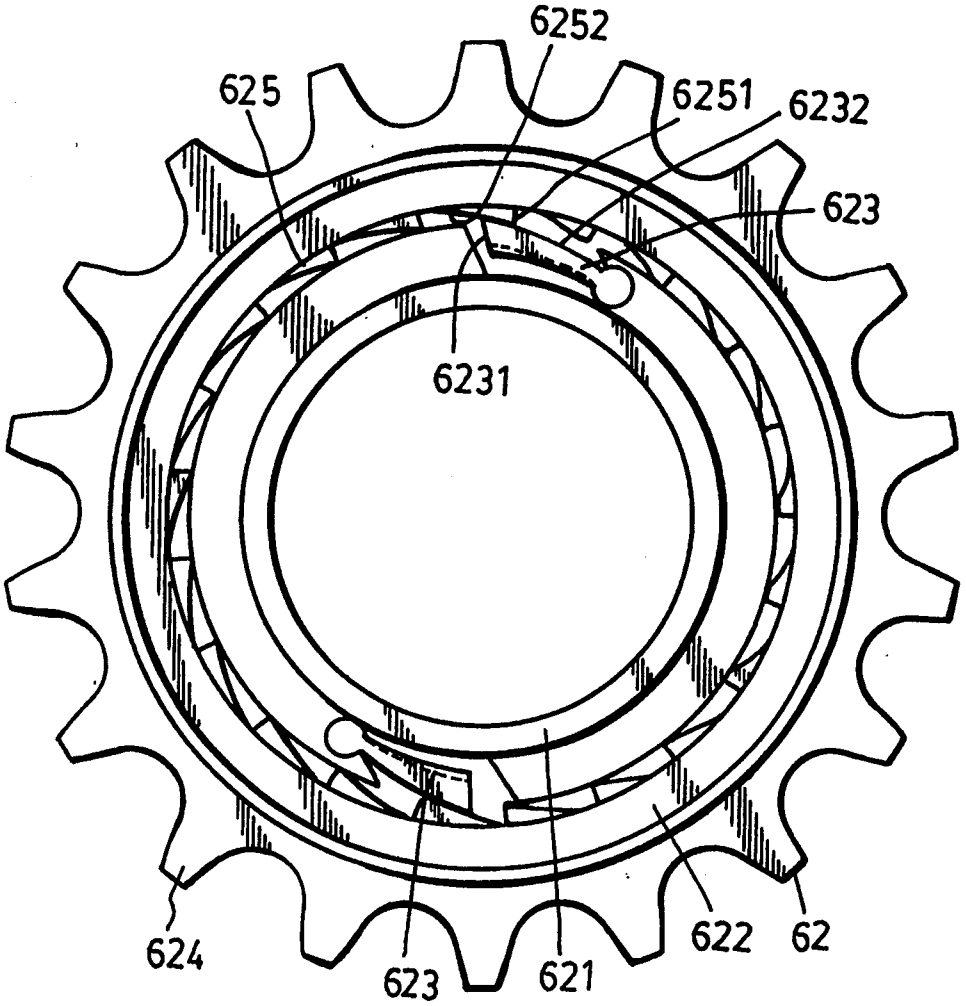
FIG. 5 is an illustration of a one-way clutch employed in the transmission system shown in FIG. 4.

The transmission system 60 serves to link the foot pedal cranks 32 to the resistance wheel 50 and further includes a second drive shaft 61, a one-way clutch 62, a third drive shaft 63, a sprocket set 64 and a drive chain set 65. Referring to FIG. 4, the second drive shaft 61 is mounted rotatably on the frame 20 between the front and rear end portions of the latter. Referring to FIG. 5, the one-way clutch 62 includes an inner wheel 621 and an outer wheel 622. The inner wheel 621 is to be secured on the second drive shaft 61 and has an outer periphery which is provided with a pair of resilient pawls 623. The outer wheel 622 has an outer periphery which is formed with sprocket teeth 624 and an inner periphery which is formed with ratchet teeth 625. Each ratchet tooth 625 has an upright edge 6251 which engages an end face 6231 of one of the resilient pawls 623 in order to permit the inner wheel 621 to rotate with the outer wheel 622 in a clockwise direction. Each ratchet tooth 625 further has an inclined face 6252 which permits a side face 6232 of the resilient pawls 623 to slide past the same in order to permit free rotation of the outer wheel 622 in a counterclockwise direction and in order to permit the inner wheel 621 to rotate freely in a clockwise direction when driven rotatably by the second drive shaft 61.

Figure 6:
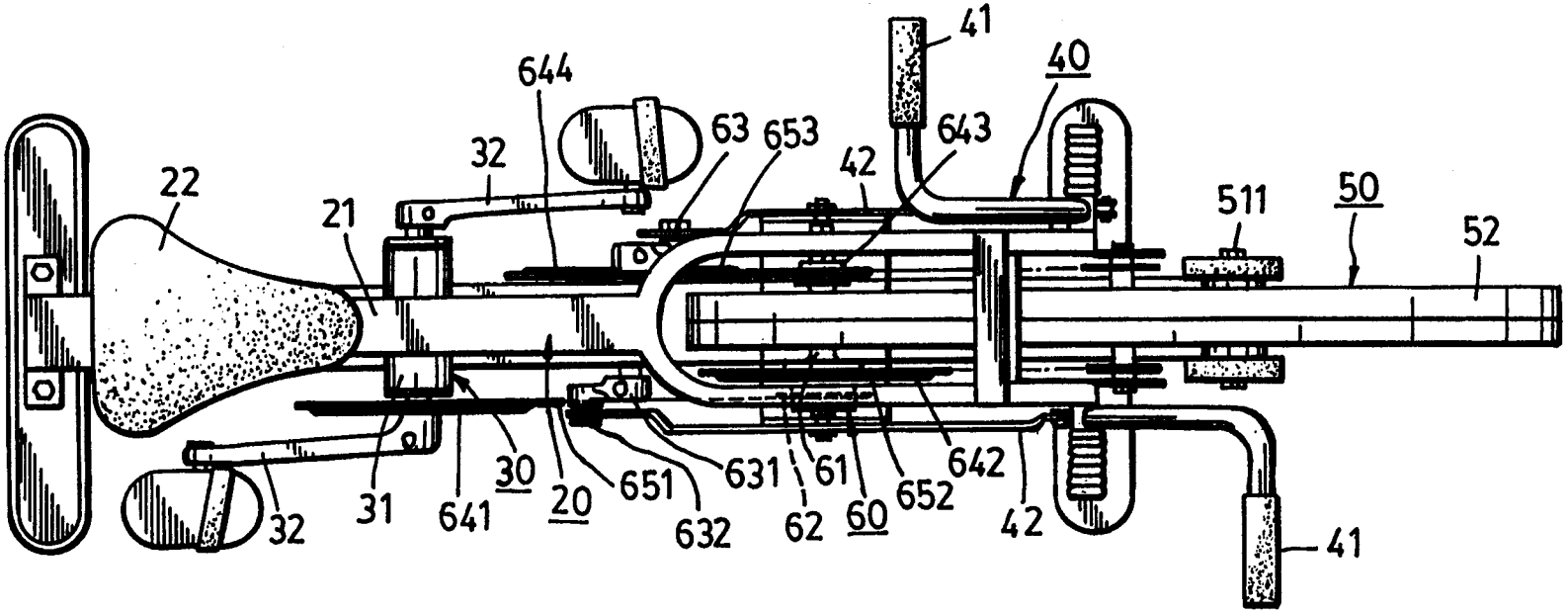
FIG. 6 is a top view of the preferred embodiment.

Referring to FIGS. 4 and 6, the third drive shaft 63 is mounted rotatably on the frame 20 between the front and rear end portions of the latter. A pair of eccentric arms 631 are mounted securely on two ends of the third drive shaft 63 and are oriented in opposite directions. Each of the crank arms 42 has a first end connected pivotally to a lower end of a respective one of the arm levers 41 and a second end connected to the distal end of a respective one of the eccentric arms 631 by means of a pin 632.

The sprocket set 64 includes five sprockets 641–645. The first sprocket 641 is mounted securely on the first drive shaft 31. The second and third sprockets 642, 643 are mounted securely on the second drive shaft 61. The fourth sprocket 644 is mounted securely on the third drive shaft 63. The fifth sprocket 645 is mounted securely on the axle 511 of the resistance wheel 50.

The drive chain set 65 includes three drive chains 651–653. The first drive chain 651 is trained between the first sprocket 641 and the outer wheel 622 of the one-way clutch 62. The second drive chain 652 is trained between the second and fifth sprockets 642, 645. The third drive chain 653 is trained between the third and fourth sprockets 643, 644.

When the foot pedal cranks 32 are operated in a clockwise direction, the first drive shaft 31 is rotated to rotate the first sprocket 641 therewith. The first sprocket 641 drives the second drive shaft 61 to rotate via the first drive chain 651 and the one-way clutch 62, thereby rotating the second and third sprockets 642, 643. The second sprocket 642 drives the axle 511 to rotate via the fifth sprocket 645 and the second drive chain 652, thereby rotating the resistance wheel 50. At the same time, the third sprocket 643 drives the third drive shaft 63 to rotate via the fourth sprocket 644 and the third drive chain 653. Because the crank arms 42 are connected eccentrically to the third drive shaft 63, rotation of the third drive shaft 63 results in forward and rearward movement of the crank arms 42 to produce reciprocating movement of the arm levers 41.

When the foot pedal cranks 32 are operated in a counterclockwise direction, the one-way clutch 62 prevents the foot pedal cranks 32 from driving rotatably the second drive shaft 61. Thus, reciprocating movement of the arm levers 41 and rotation of the resistance wheel 50 do not occur. The initial positions of the foot pedal cranks 32 can be adjusted at this stage to suit the user's needs.

When the arm levers 41 are oscillated, the crank arms 42 move so as to drive rotatably the third drive shaft 63 via the eccentric arms 631. The fourth sprocket 644 rotates with the drive shaft 63 and drives rotatably the second drive shaft 61 via the third sprocket 643 and the third drive chain 653. The second sprocket 642 rotates with the second drive shaft 61, thus permitting the rotation of the resistance wheel 50 when the arm levers 41 are oscillated.

Referring once more to FIG. 5, clockwise rotation of the inner wheel 621 of the one-way clutch 62 with the second drive shaft 61 will prevent the resilient pawls 623 from engaging the ratchet teeth 625. Thus, the outer wheel 622 of the one-way clutch 62 does not rotate to prevent rotation of the first drive shaft 31 and the foot pedal cranks 32. However, counterclockwise rotation of the inner wheel 621 of the one-way clutch 62 with the second drive shaft 61 will enable the outer wheel 622 to rotate with the inner wheel 621, thus resulting in the rotation of the first drive shaft 31 and the foot pedal cranks 32.

It has thus been shown that the present invention can be operated so as to disengage selectively the foot pedal cranks 32 when the arm levers 41 are oscillated. Furthermore, since the foot pedal cranks 32 are not connected eccentrically to the first drive shaft 31, smooth operation of the foot pedal assembly 30 can be achieved easily.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An exercise bicycle including a frame with a front end portion and a rear end portion, a seat mounted on said frame, a foot pedal assembly including a pair of foot pedal cranks, a resistance wheel having an axle mounted rotatably on said front end portion of said frame, a transmission system to link said foot pedal assembly to said resistance wheel, and a reciprocating arm assembly including a pair of reciprocating arm levers mounted pivotally on said front end portion of said frame, wherein the improvement comprises:

said transmission system including: a first drive shaft mounted rotatably on said rear end portion of said frame, said foot pedal cranks being mounted on two ends of said first drive shaft; a second drive shaft mounted rotatably on said frame between said front and rear end portions; a one-way clutch including an inner wheel with an inner periphery and an outer periphery, said inner wheel being secured on said second drive shaft, an outer wheel with an inner periphery and an outer periphery formed with sprocket teeth, and a ratchet-and-pawl unit formed on said outer periphery of said inner wheel and said inner periphery of said outer wheel; a third drive shaft mounted rotatably on said frame between said front and rear end portions of said frame; a first sprocket mounted securely on said first drive shaft; second and third sprockets mounted securely on said second drive shaft; a fourth sprocket mounted securely on said third drive shaft; a fifth sprocket mounted securely on said axle of said resistance wheel; a first drive chain trained between said first sprocket and said outer wheel of said one-way clutch; a second drive chain trained between said second and fifth sprockets; and a third drive chain trained between said third and fourth sprockets; and said reciprocating arm assembly further including a pair of crank arms, each of which having a first end connected pivotally to a lower end of a respective one of said arm levers and a second end connected eccentrically to a respective end of said third drive shaft.

* * * * *